US011376638B2

(12) United States Patent
Nugent et al.

(10) Patent No.: US 11,376,638 B2
(45) Date of Patent: Jul. 5, 2022

(54) DIRECTIONALLY ADJUSTABLE FOAM GENERATING ATTACHMENT FOR A HOSE

(71) Applicants: Michael Nugent, Fort Myers, FL (US); Robert E. Bacon, Greensboro, NC (US)

(72) Inventors: Michael Nugent, Fort Myers, FL (US); Robert E. Bacon, Greensboro, NC (US)

( * ) Notice: Subject to any disclaimer, the term of this patent is extended or adjusted under 35 U.S.C. 154(b) by 327 days.

(21) Appl. No.: 16/826,452

(22) Filed: Mar. 23, 2020

(65) Prior Publication Data

US 2020/0306800 A1 Oct. 1, 2020

Related U.S. Application Data

(60) Provisional application No. 62/919,742, filed on Mar. 27, 2019.

(51) Int. Cl.

| | |
|---|---|
| ***B08B 3/00*** | (2006.01) |
| ***B08B 3/08*** | (2006.01) |
| ***B08B 3/02*** | (2006.01) |
| ***B05B 7/00*** | (2006.01) |

(52) U.S. Cl.

CPC ..... *B08B 3/003* (2013.01); *B05B 7/005* (2013.01); *B05B 7/0018* (2013.01); *B08B 3/026* (2013.01); *B08B 3/08* (2013.01)

(58) Field of Classification Search

CPC ..... B05B 7/0018; B05B 7/005; B05B 7/2445; B05B 7/2462; B05B 15/652; B05B 1/3026; B08B 3/003; B08B 3/026; B08B 3/08; B01F 23/235; B01F 25/316; B01F 35/7132

See application file for complete search history.

(56) References Cited

U.S. PATENT DOCUMENTS

| | | | | |
|---|---|---|---|---|
| 2,577,025 | A | 12/1951 | Lundberg | |
| 3,632,046 | A * | 1/1972 | Hengesbach | B05B 7/2443 239/416.1 |
| 3,964,689 | A | 6/1976 | Horvath, Jr. | |
| 5,848,752 | A | 12/1998 | Kolacz et al. | |
| 6,113,004 | A * | 9/2000 | Steingass | A62C 5/02 239/152 |
| 6,685,107 | B1 | 2/2004 | Salzman | |
| 10,427,180 | B2 | 10/2019 | Pochtler | |
| 2012/0305272 | A1 | 12/2012 | Grandpierre | |
| 2016/0184847 | A1 * | 6/2016 | Hammerlund | B01F 33/50114 239/304 |
| 2017/0304786 | A1 * | 10/2017 | Hubmann | B01F 25/31242 |
| 2018/0221897 | A1 | 8/2018 | Collins | |

* cited by examiner

*Primary Examiner* — Vishal Pancholi
(74) *Attorney, Agent, or Firm* — Harpman & Harpman

(57) ABSTRACT

A foam generating spray nozzle for water jet hose attachments having an adjustable spray nozzle that provides incremental directional nozzle outlet adjustment. A cleaning mixture reservoir having premeasured dissolvable cleaning product pod receivable within in fluid communication with the nozzle assembly. Selective cleaning product mix reservoir access provides fluid reservoir product to the nozzle fluid stream under metered acceleration and aeration foam prior to direct outlet nozzle directional adjustment and spray stream deflector downstream thereof.

8 Claims, 6 Drawing Sheets

DIRECTIONALLY ADJUSTABLE FOAM GENERATING ATTACHMENT FOR A HOSE

This application claims the benefit of U.S. Provisional Application No. 62/919,742, filed on Mar. 27, 2019.

BACKGROUND OF THE INVENTION

1. Technical Field

This invention relates to portable cleaning devices that supply a water stream under pressure for enhanced cleaning generally referred to as a jet power washer that uses only available domestic water supply with limited water pressure. Such "water jet" devices may have cleaning solution inlets and cleaning reservoirs to which cleaning detergents are added and then disbursed creating a foam spray onto the surface to be cleaned.

2. Description of Prior Art

Prior art devices have been directed to a variety of foam generating attachments and stand alone devices in various forms and configurations, see for example U.S. Pat. Nos. 2,577,025, 3,964,689, 5,848,752, 6,685,107 and 10,427,180.

Also see U.S. Patent Publications 2012/0305272 and 2018/0221897.

U.S. Pat. No. 2,577,025 discloses a foam nozzle attachment for spray guns having a soap reservoir and a foam generating nozzle head end.

U.S. Pat. No. 3,964,689 is directed to a hose end device having a fluid container with a nozzle outflow to draw in and mix container contents with a fluid flow from a water hose source created foam.

U.S. Pat. No. 5,848,752 claims a foam aeriation nozzle that agitates and aerates the spray to produce a foam.

U.S. Pat. No. 6,685,107 shows a soap dispensing spray nozzle that injects liquid soap into a water stream to generate foam.

U.S. Pat. No. 10,427,180 discloses a device for discharging fluids having a compressed gas capsule with pressure regulated to draw up and discharge a liquid medium such as hot chocolate.

U.S. Publication 2012/0305272 shows a foam generating device for fire hoses and U.S. Publication 2018/0221897 illustrates a portable mixing device for spraying materials.

SUMMARY OF THE INVENTION

A compact foam jet attachment for water hoses that provides an inline product foam spray using premeasured dissolving pods of cleaning material within a mixing container. A multiple positionable spray nozzle outlet allows for fixed directional repositioning of the nozzle outlet direction to dispense a foam generated solution from a foam solution accelerated component within the nozzle downstream of the pod product mixing container and upstream of the directional nozzle outlet and spray deflector.

DETAILED DESCRIPTION OF THE INVENTION

Figure 1:
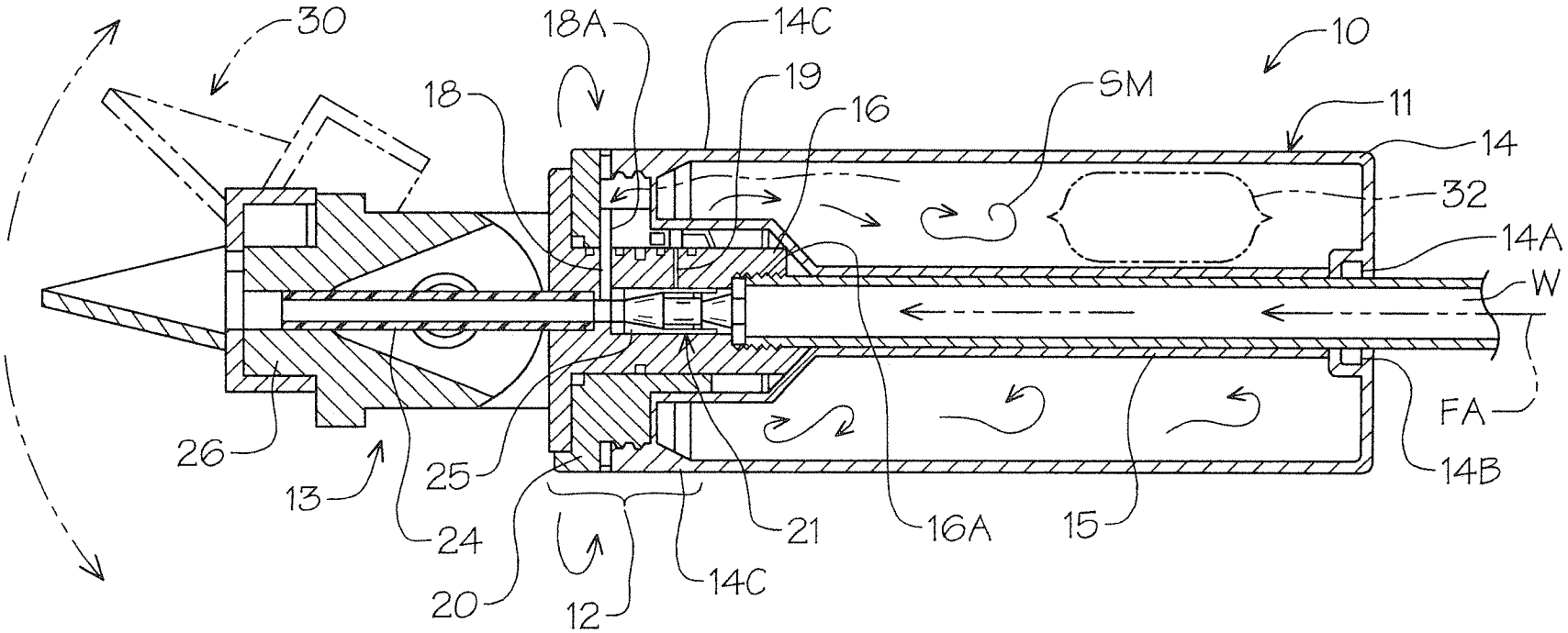
FIG. 1 is a cross-sectional view of the directional foam attachment on lines 1-1 of FIG. 2.
Figure 2:
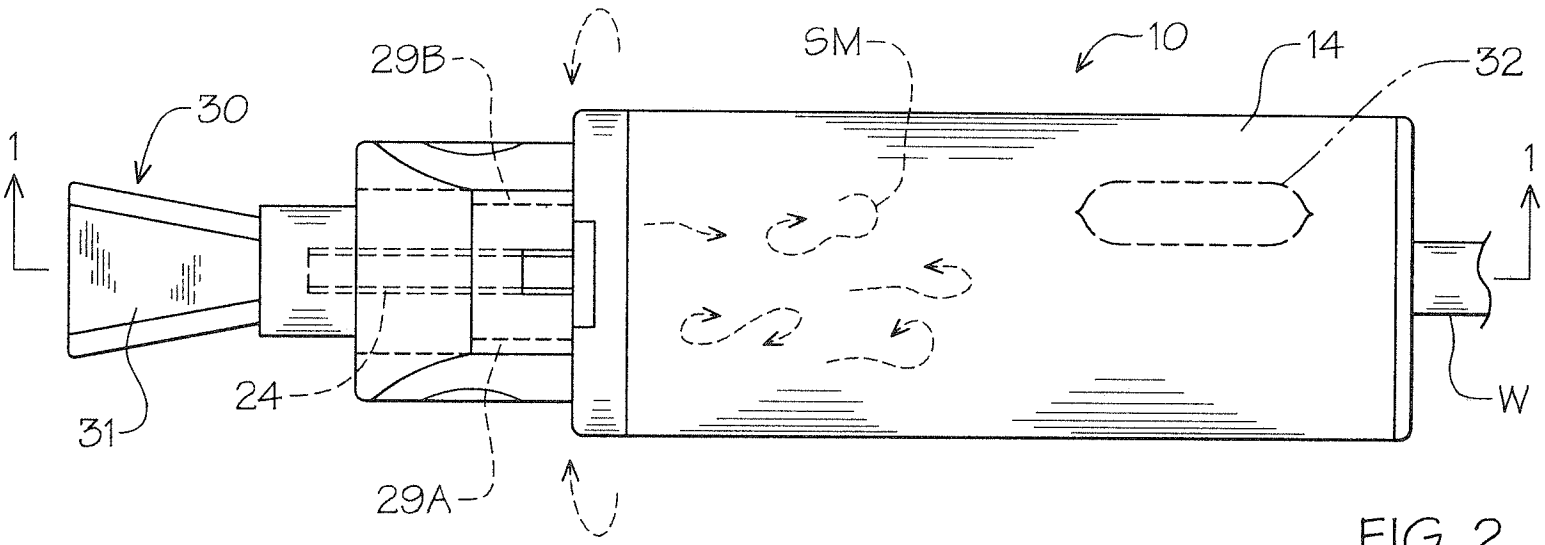
FIG. 2 is a top plan view of the directional foam attachment of the invention.
Figure 3:
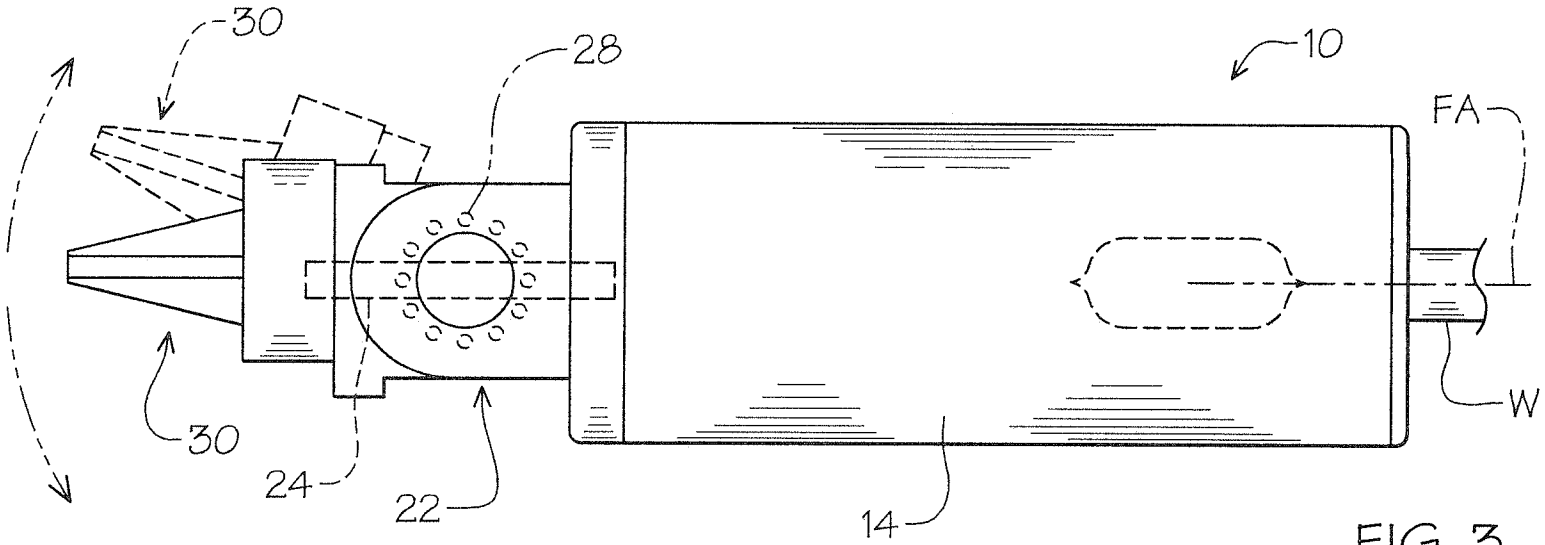
FIG. 3 is a side elevational view thereof with portions in broken lines indicating a directional repositioning.

Referring to FIGS. 1-3 of the drawings a direct foam jet attachment 10 for a hose, not shown, can be seen. The directional foam jet attachment 10 has a reservoir inlet portion 11, a foam generating portion 12 and a directional nozzle outlet portion 13. The reservoir inlet portion 11 has a fluid receiving container 14 in fluid communication with a water source, not shown, and a bottle tube 15 there within. The receiving container 14 is used for product mixing and dispensing an amount of cleaning fluid mixture through the foam generation portion 12 as will be described in greater detail hereinafter.

Figure 4:
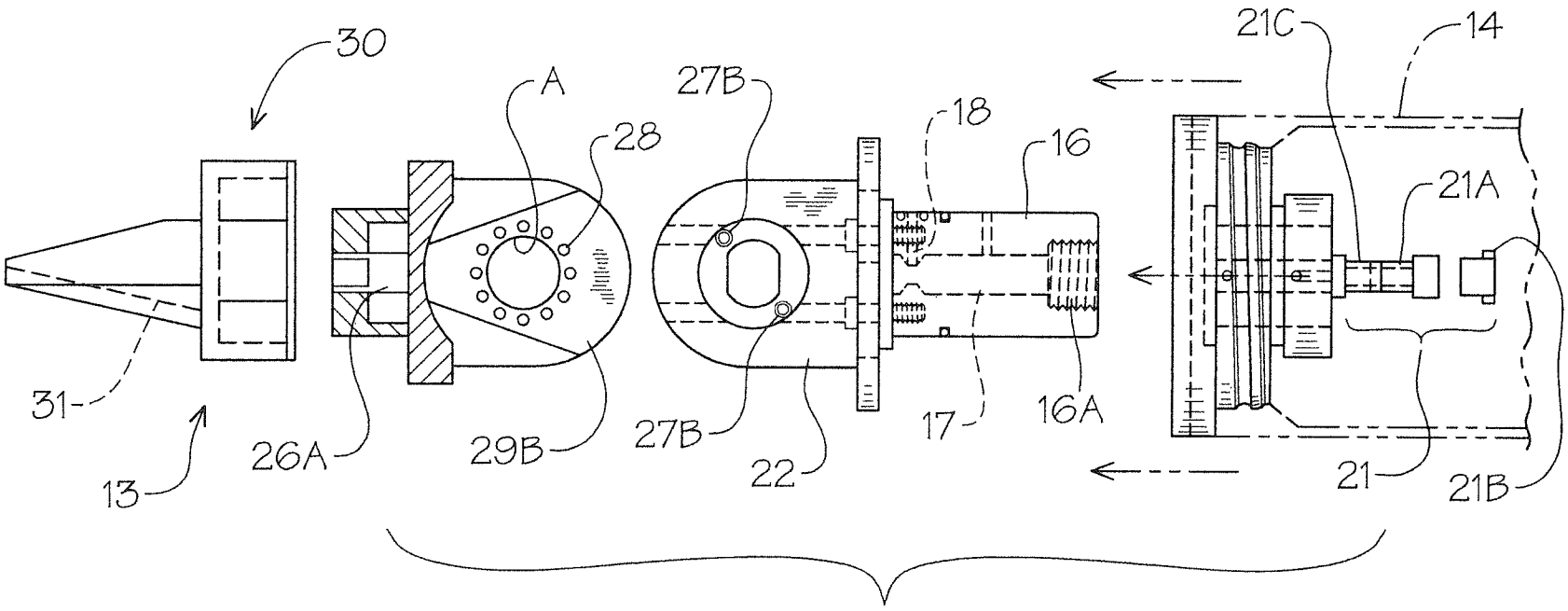
FIG. 4 is a side elevational exploded view of the directional nozzle foam attachment.

The fluid receiving container 14, best seen in FIGS. 1-3 and 6 of the drawings has a central annular recess opening at 14A for receiving an O-ring wand seal 14B and oppositely disposed open threaded end 14C that is threadably engaged by the foam generation portion 12 and forms an outlet closure thereon, as best seen in FIGS. 1 and 4 of the drawings.

The foam generation portion 12 is defined by a pitot housing nozzle socket main body member 16 having a pitot assembly receiving chamber 17 with a threaded end inlet at 16A for receiving a water supply wand W. The pitot assembly receiving chamber 17 has an area of reduced dimension at 17A from which a mixing port inlet at 18 extends in communication with cleaning solution mix SM within the fluid receiving container 14 as will be described in detail hereinafter.

A water pressure supply port 19 extends from the pitot assembly receiving chamber 17 which supplies water under pressure from the supply wand W. The nozzle socket body 16 is sealing and received within an exterior threaded aperture closure housing 20 of the foam generation portion 12 which has correspondingly aligned inlet ports 18A and supply port 19A respectively as seen in FIGS. 8 and 9 of the drawings.

Figure 8:
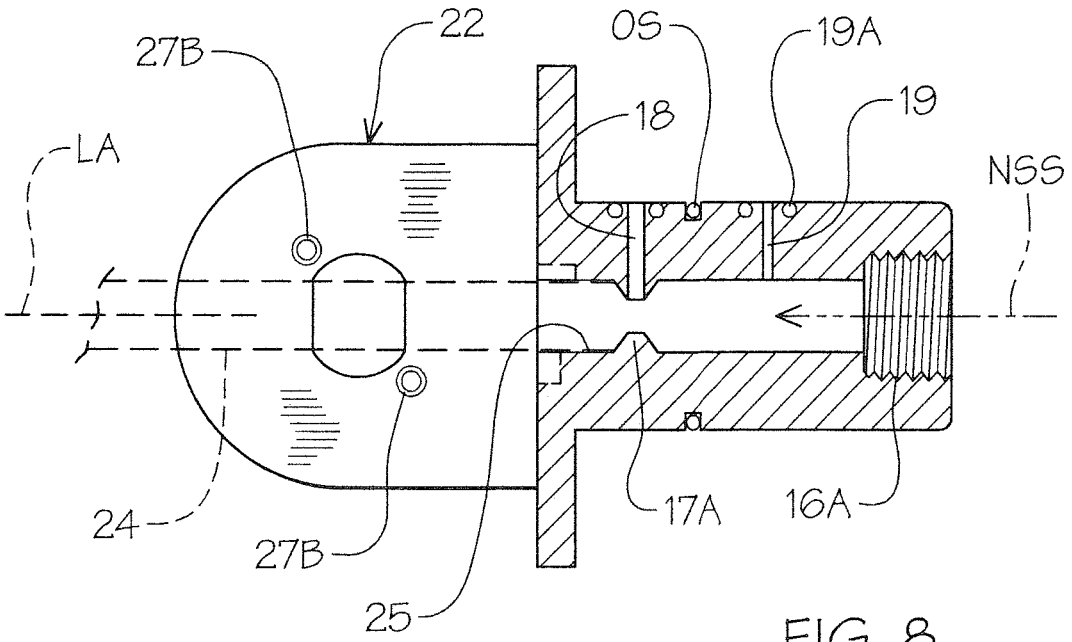
FIG. 8 is a section on lines 8-8 of FIG. 7.
Figure 9:
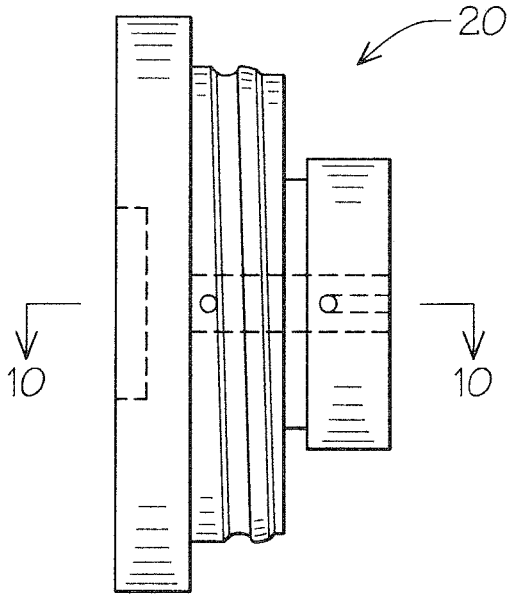
FIG. 9 is an enlarged top plan view of the directional nozzle attachment housing.
Figure 10:
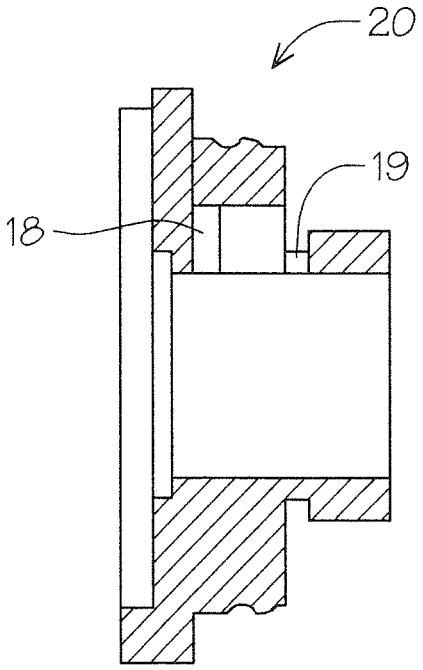
FIG. 10 is a section on lines 10-10 of FIG. 9.

It will be seen that O-ring seals OS are provided around each of the registration inlet ports 18 and 18A and supply ports 19 and 19A which allows for annular rotation there between for an effective "on/off" control of the cleaning solution mix SM from within the fluid receiving container 14 into the nozzle water supply stream NSS indicated by broken line arrows and graphically indicated in FIGS. 1 and 8 of the drawings.

Referring now to FIGS. 1-4 of the drawings, a pitot assembly 21 can be seen that is registerably positioned within the pitot retaining chamber 17 as hereinbefore described. The pitot assembly 21 has an entrance tube 21A and a tube insert 21B, best seen in FIG. 4 of the drawings, having a contoured body with a ported opening at 21C that imparts to the fluid stream mixed inflow from the mix inlet 18.

The pitot assembly 21 works in concert within the pitot assembly retaining chamber 17 and its so defined venturi effect to generate a foam inducing fluid stream to the nozzle outlet portion 13 for an enhanced jet-like "power washer" effect known within the industry.

Figure 5:
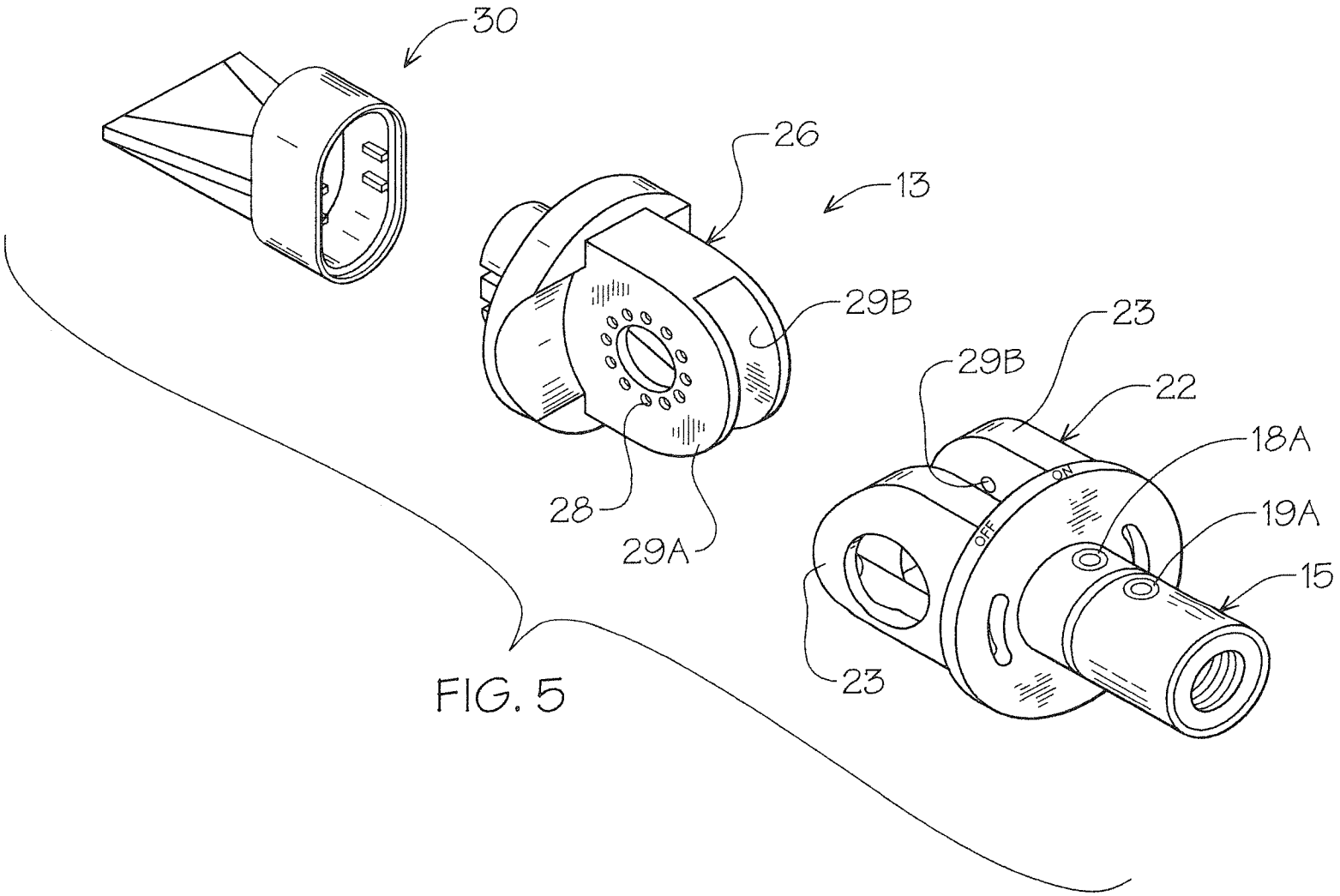
FIG. 5 is an exploded perspective view of the directional nozzle portion of the directional foam attachment.
Figure 6:
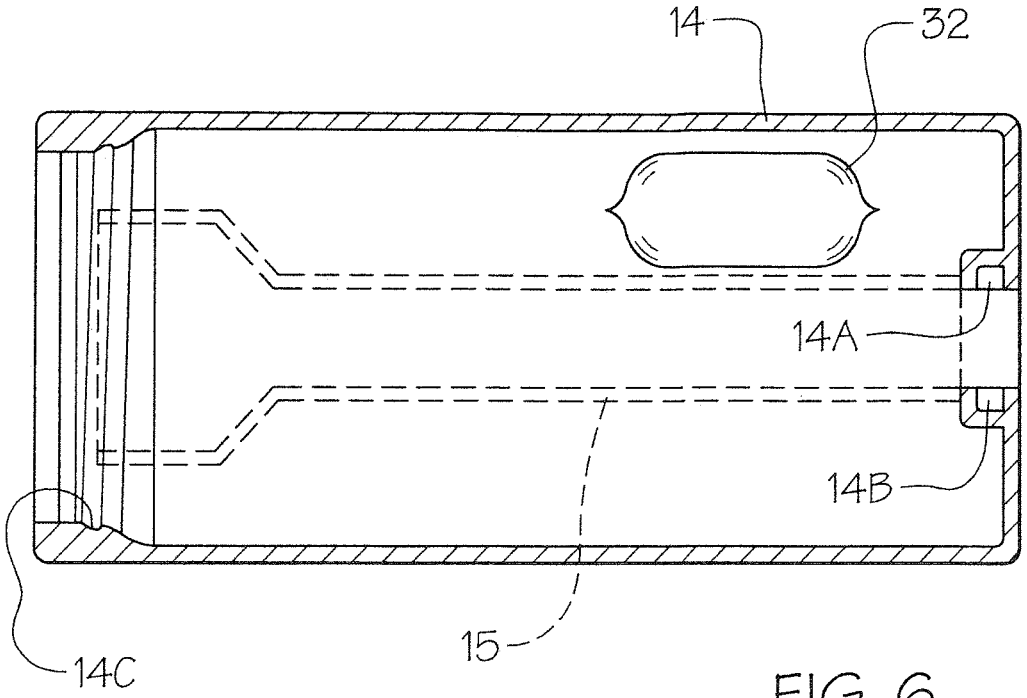
FIG. 6 is a side elevational view of the directional foam attachment product mixing container and control mount bottle tube shown in broken lines.
Figure 7:
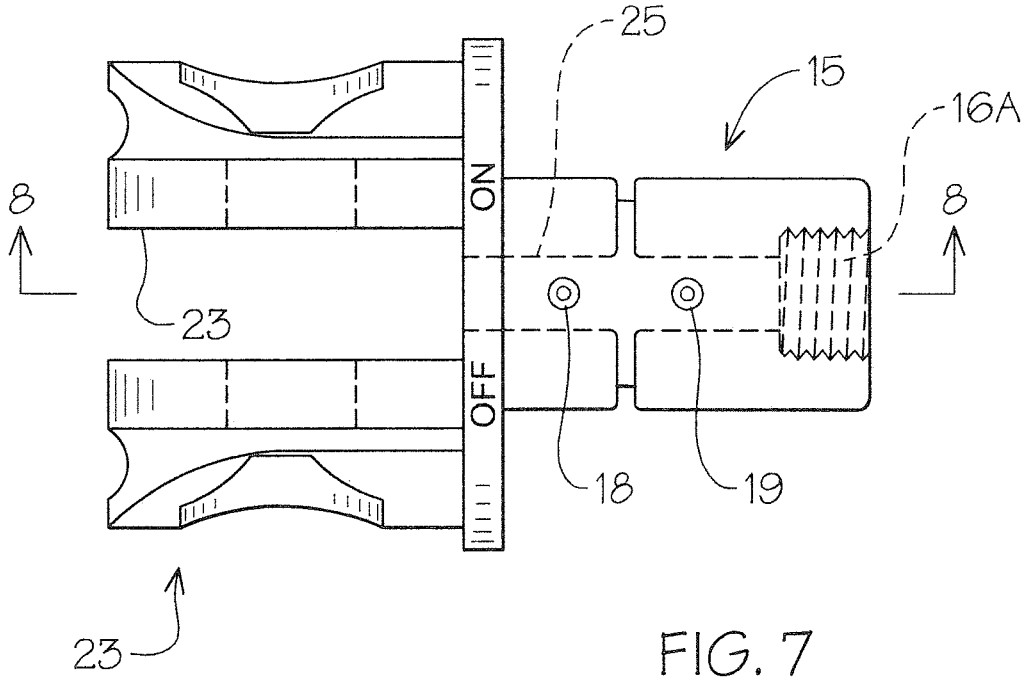
FIG. 7 is an enlarged top plan view of the directional nozzle outlet.

Referring now to FIGS. 1, 4 and 5 of the drawings, the directional nozzle outlet portion 13 has a bifurcating indexing support frame 22 with a spaced oppositely disposed aligned apertured indexing surfaces 23 thereon. A flexible nozzle hose 24 extends from a hose port 25 within and is slidably disposed within an annular displacement fitting 26 at 26A which is registerably positioned between the indexing surfaces 23 of the indexing support frame 22.

Pairs of resilient indexing buttons 27A and 27B provide indexing stops with selective so aligned annular spaced detents 28 about corresponding aligned apertures A in the spaced parallel armatures 29A and 29B extending from the displacement fitting 26. It will thus be seen that the nozzle outlet portion 12 will thereby allow for nozzle outlet angular redirection from its longitudinal axis LA indicated in broken lines in FIGS. 1 and 3 of the drawings.

It will now be seen that a fan spray nozzle diverter 30 having a tapered interior surface 31 is attached to the free end of the nozzle displacement fitting 25.

In operation, the directional foam jet attachment 10 is prepared for use by the insertion of a pod 32 which is filled with a premeasured amount of cleaning solution or other water soluble components dependent on use and is shown in broken lines within the fluid container 14 once removed from the threaded engagement with the closure housing 20 of the foam generation portion 12.

The cleaning dispenser pod 32 is made of dissolvable material and filled, as noted, with concentrated cleaning solution with the strength and viability dependent on the intended use determined by the user, not shown. The container 14, as noted, is threadably secured to the foam generation portion 12, as described and water indicated by flow arrows FA is supplied through the fluid supply wand W extending into the container 14 and threadably received therewith.

It will be evident from the above description that operational rotation of the nozzle body member 16 is predicated based on the "on/off" indicia thereon which thereby selectively aligns the mixing inlet and supply ports 18 and 19 respectively that fills the fluid receiving container 14 dissolving the cleaning pod 32 there within and dispensing a predetermined flow of concentrated cleaning mix into the dispensing nozzle via the inlet mix port 18 as disclosed. The nozzle's directional orientation can be changed, as needed, by the user, not shown, achieved through the angular interior deflection of a flexible nozzle outlet supply hose 24 maintaining a direct communicational outlet with the nozzle flow stream NSA as it passes through and from foam generation portion 12 to the nozzle outlet and against the nozzle diverter 30 which can be independently rotated for directional spray impingement and associated patterns.

It will thus be seen that a new and novel directional adjustable foam generating attachment for a hose has been illustrated and described and it will be apparent to those skilled in the art that various changes and modifications may be made therein without departing from the spirit of the invention. Therefore, I claim:

The invention claimed is:

1. A foam generating cleaning device to be connected to a source of water, the cleaning device comprises:

a mixture reservoir in fluid communication with a water source, a premeasured cleaning pod within said mixture reservoir, a water inlet in said mixture reservoir comprising an inlet tube sealingly extending there through, a foam generating portion in direct communication with said inlet tube and in select communication with said mixing reservoir, a pitot assembly in said foam generating nozzle, a nozzle outlet assembly having a flexible nozzle hose movable from a first axially aligned position with said inlet tube to a second angularly offset position, an indexing assembly for maintaining said axial aligned position of said nozzle outlet assembly.

2. The foam generating cleaning device set forth in claim 1 wherein said source of water comprises a water wand.

3. The foam generating cleaning device set forth in claim 1 wherein said mixing reservoir is removably sealed onto the nozzle outlet assembly.

4. The foam generating cleaning device set forth in claim 1 wherein said foam generating nozzle assembly selectively communicates with said mixing reservoir comprises:

a pitot receiving chamber, a mixing port inlet therein and a fluid supply port.

5. The foam generating cleaning device of claim 1 wherein said foam generating portion comprises:

a pitot housing nozzle socket body receivable within a mixture reservoir apertured closure housing for axial rotation there within.

6. The foam generating cleaning device set forth in claim 1 wherein said pitot assembly further comprises:

an entrance tube, portal opening in said entrance tube and a tube insert.

7. The foam generating cleaning device set forth in claim 4 wherein said pitot receiving chamber further comprises:

an area of reduced dimension in communication with said mixing port inlet.

8. The foam generating cleaning device set forth in claim 1 wherein said flexible nozzle hose is in retained communication within a pitot housing nozzle main socket body and slidably displaced in an annular displacement fitting.

* * * * *